US005199339A

United States Patent [19]

Creech

[11] Patent Number: 5,199,339

[45] Date of Patent: Apr. 6, 1993

[54] H BEAM HOLE PUNCH

[75] Inventor: Clyde W. Creech, Phoenix, Ariz.

[73] Assignee: C & M Enterprises, Inc., Phoenix, Ariz.

[21] Appl. No.: 793,463

[22] Filed: Nov. 18, 1991

Related U.S. Application Data

[63] Continuation of Ser. No. 512,969, Apr. 23, 1990, abandoned.

[51] Int. Cl.[5] ..... B26D 5/02

[52] U.S. Cl. ..... 83/50; 83/34; 83/527; 83/700; 83/DIG. 2

[58] Field of Search ..... 83/34, 50, 700, 527, 83/522.16, 522.24, 215, 76.3, 534, 539, 859, 684, 928, DIG. 2, 688, 529

[56] References Cited

U.S. PATENT DOCUMENTS

| | | | |
|---|---|---|---|
| 3,387,636 | 6/1968 | Pollak et al. | 143/6 |
| 3,712,161 | 1/1973 | Valente | 83/50 |
| 3,858,471 | 1/1975 | Valente | 83/527 |
| 3,892,154 | 7/1975 | Duffy | 83/368 |
| 4,457,197 | 7/1984 | Wepner et al. | 83/197 |
| 4,707,898 | 11/1987 | Creech | 29/155 |

FOREIGN PATENT DOCUMENTS

| | | | |
|---|---|---|---|
| 991343 | 3/1963 | United Kingdom | 83/215 |

*Primary Examiner*—Daniel C. Crane

*Attorney, Agent, or Firm*—Cahill, Sutton & Thomas

[57] ABSTRACT

A semi automated hole punch translates a punch and die assembly across the end of an H beam or the like to punch each of a plurality of holes in accordance with an interchangeable template. The punch and die assembly travel across the H beam in response to operation of a power source until a manually operated pivotable arm supporting a pin is brought into engagement with a hole in a template. Upon engagement, the translatory movement of the punch and die assembly ceases and an operator can actuate the punch. Upon lifting the handle to disengage the pin, translatory movement of the punch and die assembly will continue until the pin becomes engaged with a succeeding hole in the template.

18 Claims, 4 Drawing Sheets

H BEAM HOLE PUNCH

CROSS-REFERENCES TO RELATED APPLICATION

This application is a continuation application of a patent application entitled "H BEAM HOLE PUNCH", Ser. No. 07/512,969, filed Apr. 23, 1990, now abandoned, and describing an invention made by the present inventor.

BACKGROUND OF THE INVENTION

1. Field of the Invention

The present invention relates to die cutting machines and, more particularly, to a semi automated template controlled hole punch.

2. Description of the Prior Art

Beams, such as structural H beams, are joined to one another by mechanical attachment devices, such as rivets or nut and bolt sets. The H beams are profiled in accordance with the assembly requirements and holes are formed in the ends of the beams to accommodate the mechanical attachment devices. The locations of these holes are usually predetermined by construction standards commensurate with the size of the H Beams, load requirements and related well established criteria.

A long established method for forming the holes includes the use of cutting torches wielded by skilled craftsmen. This procedure produces a satisfactory result but it is time consuming and the accuracy of both the size and position of the holes is a function of the skill of the craftsman.

In an effort to minimize the dependency upon the skill of a craftsman to develop holes in structural beams and to ensure uniformity of the size and location of a plurality of holes, a die cutting machine illustrated and described in U.S. Pat. No. 4,707,898 was developed by the present inventor. In this machine, a hydraulically operated punch performs a die cutting operation to create the holes. The position of the holes is controlled by a template having the number and location of the holes to be cut formed therein. A manually operated arm includes a pin for serially engaging the holes in the template. The punch and associated supporting structure is on a pair of rollers to permit manually induced translation of the die cutting machine across the end of the beam to be die cut in correspondence with the holes in the template. Manually operated means are described for vertically positioning the punch and die commensurate with the beam to be cut. The die cutting machine works as intended but it is awkward to use because of the requirement to manually translate the very robust and heavy die cutting machine from the position of one hole to the position of the next hole as dictated by the template.

SUMMARY OF THE INVENTION

A hole punch apparatus is disposed at the output end of an H beam supporting roller conveyor to receive the end of an H beam which is to have holes punched in the web. The punch and die assembly is raised by a motor operated jack screw to support the web upon the die and position the punch thereabove. A linear actuator extending from a trolley supporting the punch and die assembly is engaged by a motor operated rotatable smooth surfaced rod to cause translation of the punch and die assembly across the web. A manually operated arm having a pin extending therefrom is pivotally attached to the punch and die assembly. A replaceable template, having holes formed therein commensurate with the number and location of holes to be punched in the web, is supported upon a stand. Upon energization of the rod actuating motor and by manually lowering the handle to permit the pin to ride upon the template, the punch and die assembly will translate across the web until the pin drops into a hole on the template. Further translatory movement of the punch and die assembly will be precluded and accommodated by slippage between the rod and the linear actuator. When the punch and die assembly has been positioned relative to the web in response to dictates of the template, the punch is actuated to form a hole in the web. After the hole has been punched, the handle is raised to disengage the pin from the template engaged hole and translatory movement of the punch and die assembly will resume until the pin engages and drops into the next hole in the template.

It is therefore a primary object of the present invention to provide a semi automated hole punch for punching holes in an H beam in accordance with the dictates of a selected template.

Another object of the present invention is to provide a hole punch which automatically locates the punch with respect to an H beam in accordance with a template.

Still another object of the present invention is to provide a manually operated pin for stopping a punch automatically translating across a work piece at a location where a hole is to be punched.

Yet another object of the present invention is to provide continuously operating apparatus for intermittently translating a hole punch between holes to be punched in a work piece.

A further object of the present invention is to provide first motive power for vertically positioning a punch and die assembly with respect to a work piece and second motive power for translating the punch and die assembly between locations of the holes to be punched.

A still further object of the present invention is to provide a manually operated arm cooperating with a template to control translation across a work piece of a hole punch and die assembly.

A still further object of the present invention is to provide apparatus for forming a plurality of apertures in the end of an H beam in accordance with a predetermined pattern immediately subsequent to profiling of the H beam end.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

DESCRIPTION OF THE PREFERRED EMBODIMENT

Presently, it is common practice to develop apertures at the ends of structural H beams used for building frameworks to secure the H beams to one another with rivets or nut and bolt sets. These apertures are formed by skilled craftsmen using a cutting torch. The number and pattern of these apertures are set by existing building standards to ensure coincidence with mating beams, gussets and plates. Necessarily, it is mandatory that the cut apertures conform with predetermined sizes and locations relative to the H beam and to one another.

Figure 1:
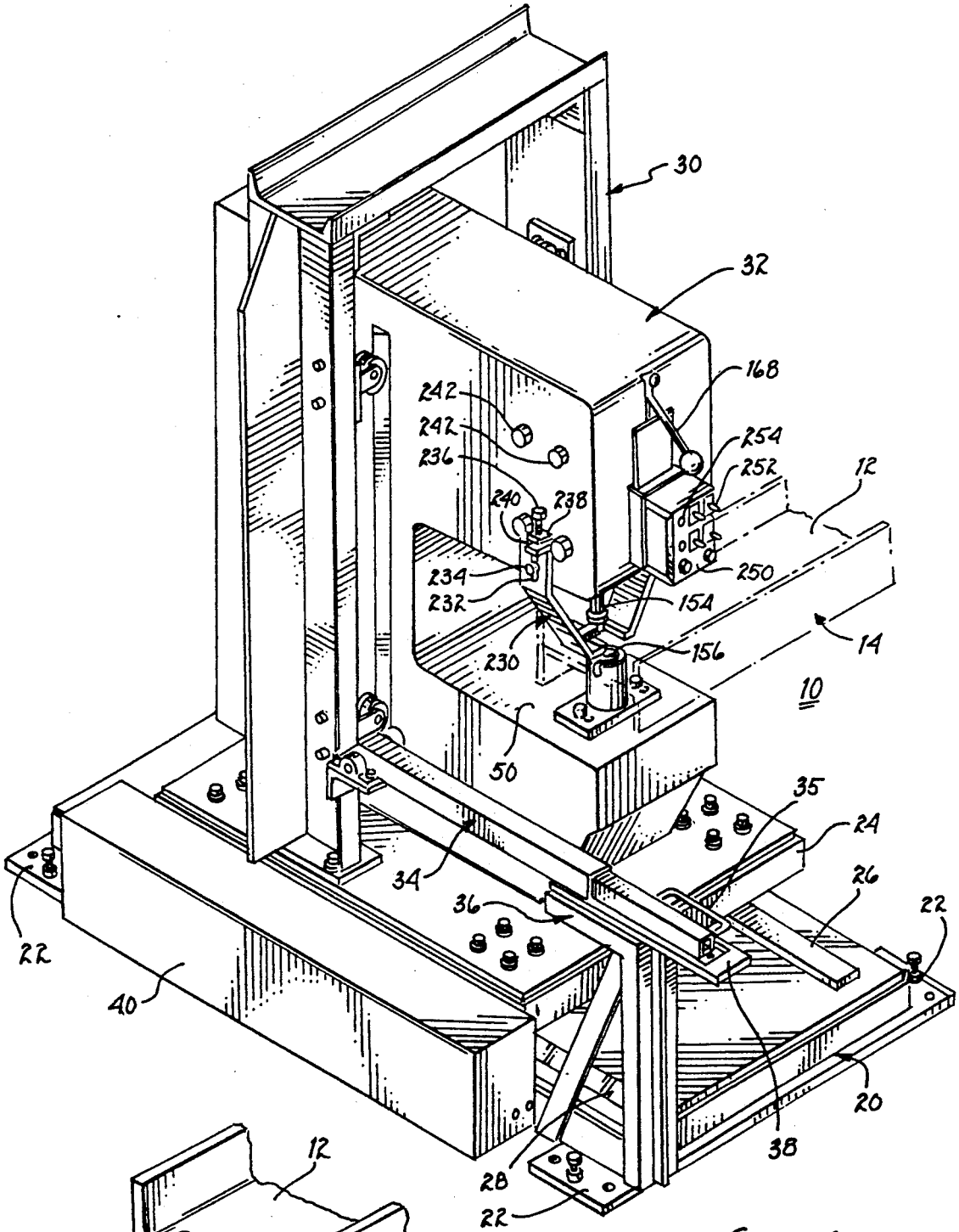
FIG. 1 is an isometric view of the hole punch assembly.
Figure 2:
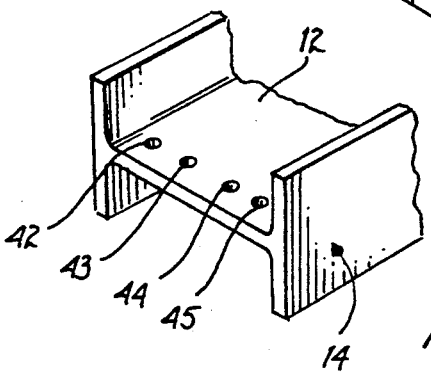
FIG. 2 illustrates a structural H beam having a plurality of representative holes formed therein.
Figure 4:
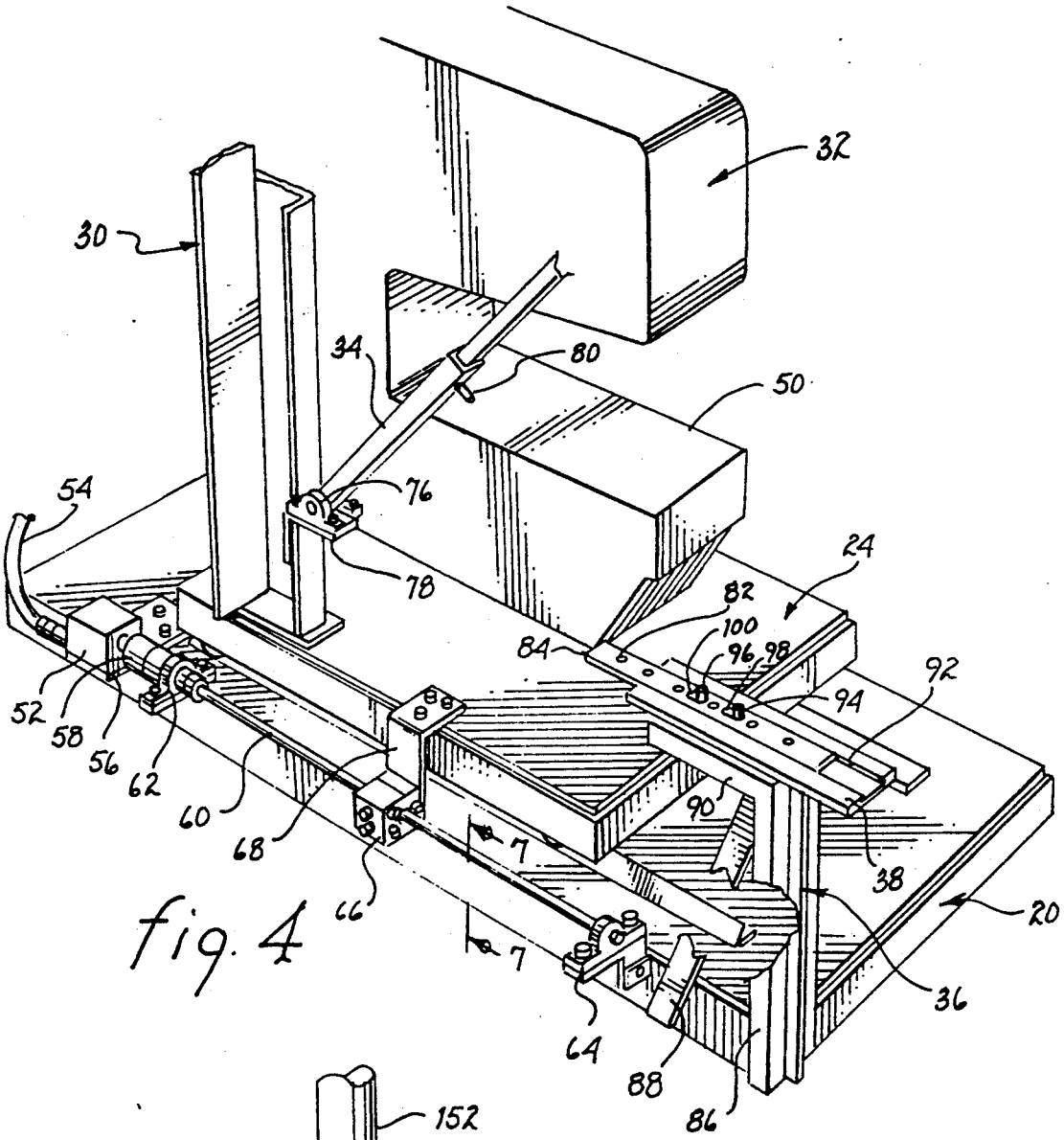
FIG. 4 illustrates the apparatus for translating horizontally the punch and die assembly and for terminating such translation in accordance with an apertured template.

Referring to FIG. 1, there is illustrated a hole cutter 10 for cutting one or more holes in web 12 of an H beam 14 representatively illustrated with dashed lines. Preferably, the hole cutter is mounted in operative relationship to a beam profiling machine to permit cutting of the holes immediately subsequent to profiling the end of the H beam to a predetermined configuration. A beam profiling machine, such as that illustrated in U.S. Pat. No. 4,707,898, includes a roller conveyor for transporting H beam 14 horizontally into position; the beam profiling machine conveyor also includes clamping means for securing the H beam in place while work is performed upon it.

Hole cutter 10 includes a base 20 attachable to the floor or other supporting surface by securing means 22 disposed at the four corners of the base. A translatable trolley 24 includes wheels supported upon a bar 26 and a track 28, which track is triangular in cross section. The bar and the track are rigidly secured to base 20. A super structure 30 is attached to an extends upwardly from trolley 24 for supporting and guiding a punch and die assembly 32 during vertical translation of the assembly. An arm 34 is pivotally secured to super structure 30 to permit manual raising and lowering of the arm by grasping handle 35. A platform 36 extends upwardly from base 20 to support a template receiver 38, which receiver supports a template operatively associated with arm 34.

A shroud 40 encloses, for protective purposes, motive means for transporting trolley 24 back and forth along bar 2 and track 28. Referring jointly to FIGS. 1, 2, 3 and 4, there will be described the apparatus for positioning punch and die assembly 32 with respect to H beam 14 to develop apertures 42,43,44 and 45 therein. After positioning H beam 14 within throat 50 of punch and die assembly 32, the punch and die assembly is transported rearwardly to its rear most position. The transport of the punch and die assembly is effected by relocating trolley 24. An electric motor 52, connected to a source of electric power through wires contained within conduit 54, is attached and mounted upon a flange 56 extending from base 20. A coupling 58 interconnects motor 52 with a smooth surfaced round rod 60. The rod is rotatably supported by pillow blocks 62,64 mounted upon further flanges extending from base 20. A linear actuator 66, sold under the trademark "ROHLIX" by Barry Wright Company of Minneapolis, Minn., is in encircling engagement with the rod. Upon rotation of the rod, the linear actuator is forced to travel along the rod forwardly or backwardly, depending upon the direction of rotation of the rod. The linear actuator is attached to trolley 24 via a bracket 68. Upon energization of motor 52, rod 60 will rotate in one direction or the other, depending upon control signals provided to the motor. Rotation of the rod will result in translation of linear actuator 66 along the rod, which motion is translated to trolley 24 through bracket 68. Thereby, translation of the trolley will come about upon energization of motor 52. The clamping force exerted by the linear actuator upon an encircling rod is adjustable. Thereby, translation of the linear actuator as a result of rotation of the rod can be stopped without exerting undue or damaging loads upon the rod, its driving motor or the linear actuator. That is, the characteristics of the linear actuator permit it to operate in the manner of a clutch to accommodate slippage without damage.

Arm 34 is secured to super structure 30 via pivot means 76 secured to the super structure with a right angle flange 78. The arm includes a positioning pin 80 for selectively engaging one of apertures 82 formed in template 84. Platform 36 includes an L shaped member 86 secured to and extending upwardly from base 20. A brace 88 extends from base 20 to leg 90 of the L shaped member to provide additional rigidity to the L shaped member. Receiver 38 is fixedly attached to leg 90 to receive and retain within slot 92 template 84. Threaded studs 94,96 extend from receiver 38 to penetrably engage elongated slots 98,100 formed in template 84. These studs, in combination with their respective slots, permit positioning and adjustment of the template relative to receiver 38 to ensure proper placement of holes 42 to 45 in H beam 14 (see FIG. 2). Holes 82 disposed in template 84 positionally correspond with the holes to be formed in the H beam. To ease and facilitate penetration of pin 80 of arm 34 serially in each of the holes, the upper end of holes 82 may be chamfered to guide the pin into the holes.

In operation, trolley 24 is initially placed in its rearward most position by energizing motor 52 to rotate rod 60 and draw linear actuator 66 and the attached trolley rearwardly. Forward movement of punch and die assembly 32 is effected by reenergizing motor 52 to cause rotation of rod 60. The rotation of rod 60 is translated by linear actuator 66 into forward movement of trolley 24. Simultaneously, arm 34 is lowered to permit pin 80 to rest upon template 84. As the pin approaches and comes into correspondence with the first of apertures 82, the pin will drop into the aperture. Because template 84 is rigidly secured to L shaped member 86 by studs 94,96, arm 34 is immobilized. The immobility of the arm is translated to super structure 30 through pivot 76 and trolley 24 is halted. Thereafter, the punch and die assembly is actuated to punch a hole in H beam 14. After the hole is punched, arm 34 is manually raised by lifting on handle 35 to disengage pin 80 from the previously engaged hole 82. Because the arm is no longer immobile, further forward movement of trolley 24 will be resumed under the influence exerted by operation of linear actuator 66. The forward movement of the trolley will result in further translation of pin 80 along template 84 until the pin encounters the next hole in the template. Thereafter, the pin will engage the hole and the trolley, along with the punch and die assembly, will again be immobilized and a further hole may be punched in H beam 14. This process is repeated until all holes have been punched, as dictated by template 84. After the holes have been punched, motor 52 is reversed in direction of operation to reposition trolley 24 to its rearward most position. The H beam may now be transported from the supporting roller conveyor (not shown) to a point of use or temporary storage area.

Figure 3:
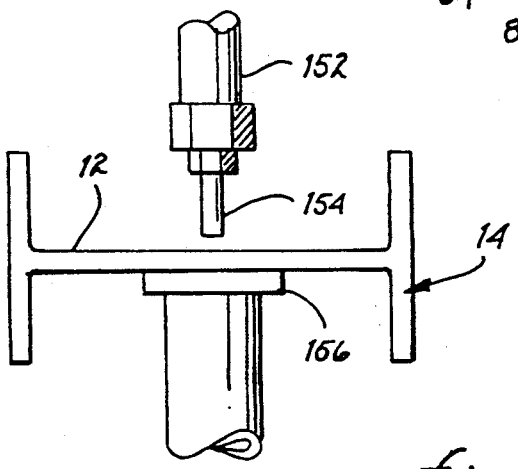
FIG. 3 is a pictorial end view of a punch and die operatively associated with an H beam to form a hole therein.
Figure 5:
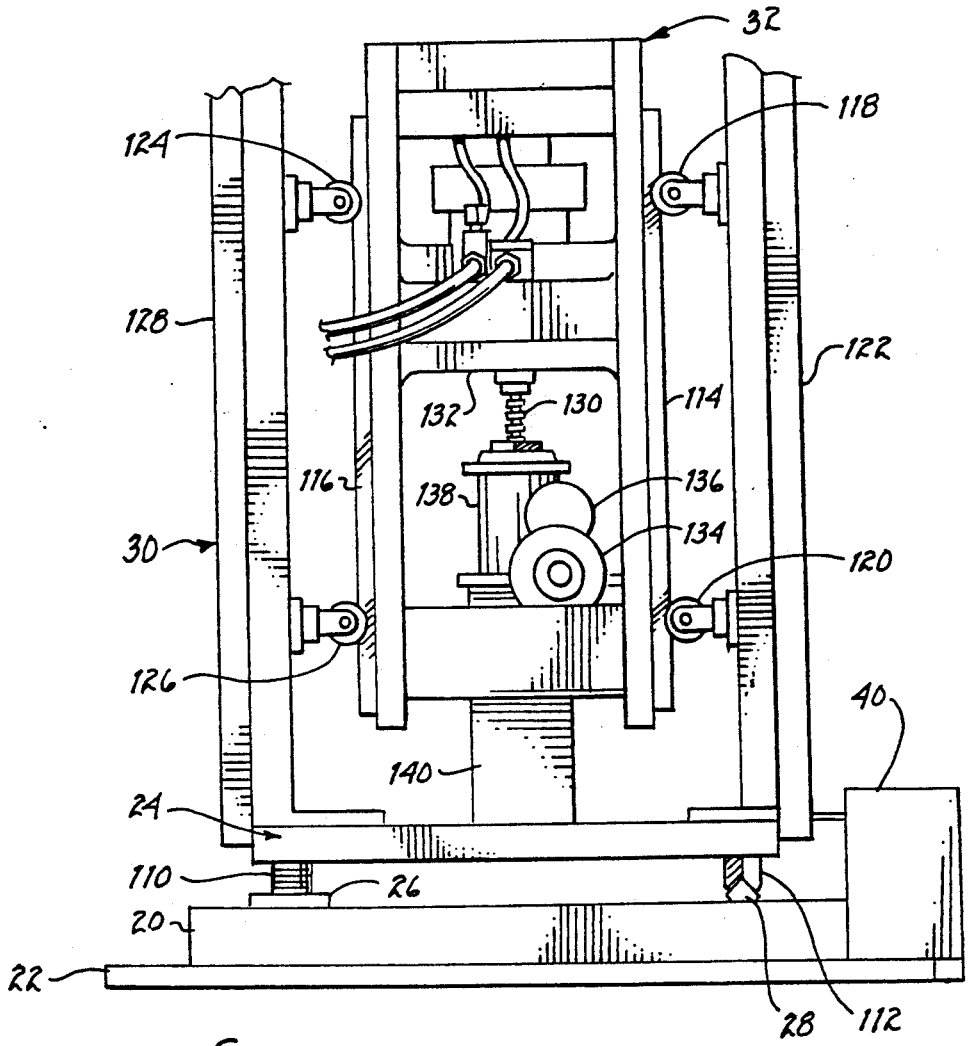
FIG. 5 is a horizontal rear view illustrating structure for vertically positioning the punch and die assembly.
Figure 6:
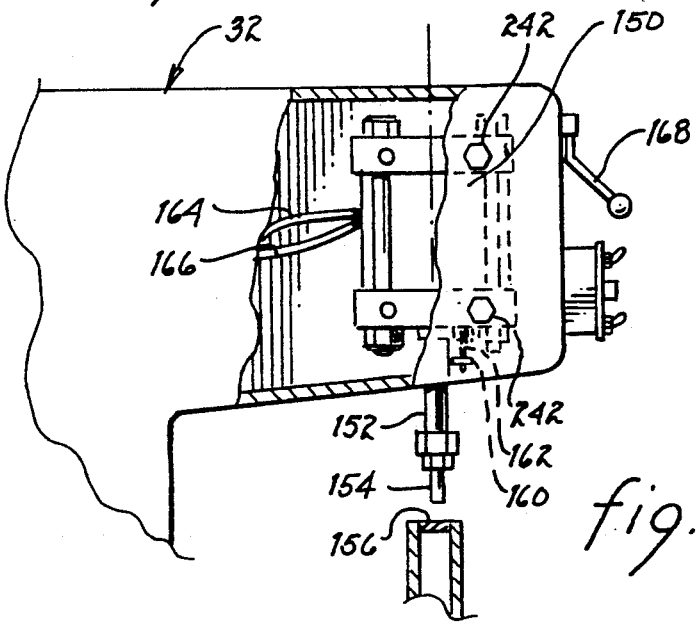
FIG. 6 is a partial cutaway view illustrating the hydraulically operated punch.

Referring jointly to FIGS. 3, 5 and 6, details of the horizontal and vertical positioning of punch and die assembly 32 and the hole punching operation will be described. As discussed above, fore and aft movement of trolley 24 is brought about by a pair of wheels 110 rotatably depending from trolley 24 rolling along bar 26 and a pair of grooved wheels 112 rotatably depending from trolley 24 and engaging track 28. The meshing of wheels 112 wit h track 28 maintains alignment of the trolley and attached super structure during fore and aft movement to ensure precision in alignment of the holes to be formed in the H beam. The punch and die assembly includes a pair of vertically oriented triangular in cross section tracks 114,116 extending laterally outwardly therefrom. A pair of grooved wheels 118,120 are pivotally attached to and extend from upright 122 of super structure 30 to engage track 114. Similarly, a pair of grooved wheels 124,126 are pivotally attached to and extend from upright 128 of super structure 30 to engage track 116. The meshing of wheels 118,120 with track 114 and wheels 124,126 with track 116, maintains punch and die assembly 32 precisely oriented vertically during vertical translation and precludes horizontal movement of any consequence.

Vertical positioning of punch and die assembly 32 is provided by a jack screw 130 in engagement with cross member 132. Rotation of the jack screw is controlled by motor 134 connected to the jack screw via a transmission 136. Base 138 of the jack screw is supported upon a pedestal 140 extending from trolley 124. Accordingly, punch and die assembly 32 is vertically positionable by operation of jack screw 130 and alignment of the assembly is controlled and regulated by the grooved wheels extending from super structure 30 and cooperating with tracks 114,116.

A hydraulic unit 150 includes a downwardly depending extension 152 supporting a punch 154. Because it is critical that punch 154 be aligned with a die 156, a pin 160 extending from the extension may be employed to cooperate with a vertical slot formed in a bracket 162. Hydraulic lines 164,166 extend from hydraulic unit 150 to a source of hydraulic fluid under pressure. A lever 168 extends from the front of punch and die assembly 32 to control vertical movement of the piston within the hydraulic unit and hence vertical movement of punch 154.

As particularly shown in FIG. 3, punch and die assembly 32 is raised by operation of jack screw 130 to locate die 156 adjacent the under surface of web 12 of H beam 14. Thereby, support is provided for the web during punching of a hole in the web. Upon completion of the hole punching operation, the punch and die assembly is lowered to an extent sufficient to have die 156 clear the web and permit sliding removal of the H beam.

Figure 7:
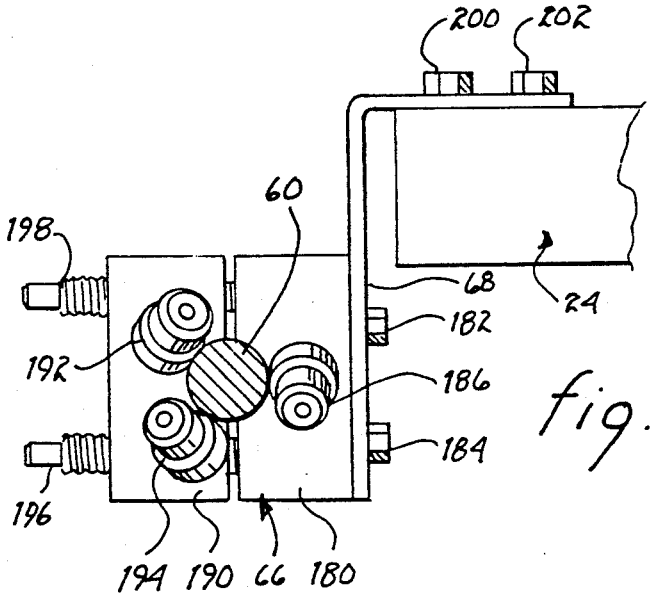
FIG. 7 is a cross sectional view taken along lines 7—7, as shown in FIG. 4.

Referring to FIG. 7, further details attendant linear actuator 68 will be described. The linear actuator includes a block 180 secured to bracket 68 by bolts 182,184. This block supports a roller 186, which roller is angled in conformance with the pitch of the linear actuator. A second block 190 supports a pair of rollers 192,194 also angled to define the pitch of the linear actuator. The two blocks are secured to one another by spring loaded bolts 196,198 which draw the two blocks toward one another and define the gripping strength or friction exerted by the rollers upon engaged rod 60. Accordingly, the amount of force required to stop translation of the linear actuator during rotation of rod 60 can be varied to accommodate the amount of force necessary to transport trolley 24 forward and backward along base 20. Bracket 68 is secured to trolley 24 via bolts 200,202.

Figure 8:
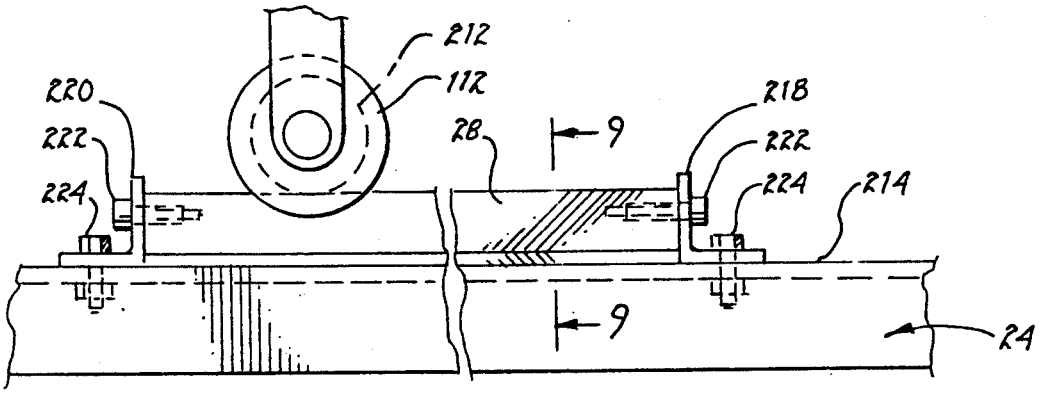
FIG. 8 is a partial view illustrating the tracks and engaging wheels of the hole punch supporting trolley.
Figure 9:
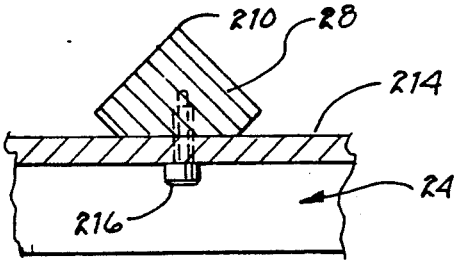
FIG. 9 is a cross sectional view taken along lines 9—9, as shown in FIG. 8.

Referring jointly to FIGS. 8 and 9, certain details attendant track 28 will be described. Track 28 includes an uppermost oriented right angle ridge 210 for nestingly engaging groove 212 within wheels 112 to minimize lateral movement and misalignment therebetween. The track is secured to plate 214 of trolley 24 by bolts 216. To prevent inadvertent disengagement of wheels 112 from track 28 right angled flanges 218,220 are secured to respective opposed ends of track 28 to interferingly engage and stop rotation of wheels 112 therepast. These flanges may be secured to the track by bolts 222 and to plate 214 by bolts 224.

Referring again to FIG. 1, a guard 230 extends downwardly from the upper part of punch and die assembly 32 to bear against the upper surface of web 12 of H beam 14 to prevent bowing and upward movement of the web during withdrawal of the punch. The guard includes vertical positioning means formed by the combination of slot 232 and cooperating bolt 234. Resistance against upward movement of the guard is provided primarily by a bolt 236 threadedly engaging support 238 and bearing against a stop 240. Bolts 242 support hydraulic unit 150 within punch and die assembly 32. A control box 250 includes switches 252 for actuating motor 52 to translate trolley 24 forwardly and backwardly and further switches for energizing motor 234 to raise and lower jack screw 130. Status indicators 254 may also be employed. Various other control functions and indicia therefore could be incorporated in the control box.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. Apparatus for transporting a punch and die assembly with respect to a beam to punch holes therein at predetermined locations, said apparatus comprising in combination;

a) a base;

b) a trolley, said trolley including super structure for supporting the punch and die assembly;

c) means for continually urging transport of said trolley across said base, said urging means including power means for conintuously urging transport of said trolley in a selected direction;

d) clutch means interconnecting said power means and said trolley for effecting movement of said trolley in response to actuation of said power means, said clutch means including means for accommodating continuing actuation of said power means upon halted transport of said trolley;

e) wheel means extending from said trolley to facilitate transport of said trolley across said base;

f) means for maintaining said wheel means along a predetermined path on said base;

g) means for halting transport of said trolley in the selected direction commensurate with the location of a hole to be punched in the beam and opposing movement of said trolley continuously urged by said power means, said halting means including a template fixedly positional relative to said base and having one hole corresponding with each hole to be punched in the beam and means attached to said trolley for engaging and disengaging the holes in said template to halt and resume, respectively, transport of said trolley in response to said urging power means;

h) motive means for raising and lowering the punch and die assembly relative to said trolley to position the punch and die of the punch and die assembly in operative position relative to the beam; and i) means for actuating the punch and die assembly upon halted transport of said trolley to punch a hole in the beam.

2. Apparatus for transporting a punch and die assembly with respect to a beam to punch holes in the beam at predetermined locations, said apparatus comprising in combination:

a) a base;

b) a trolley, said trolley including super structure for supporting the punch and die assembly;

c) means for continuously urging transport of said trolley across said base, said urging means including;

i) a rotatable rod mounted upon said base;

ii) a linear actuator mounted upon said trolley for engaging said rod, said linear actuator being rectilinearly translatably relative to said rod in response to rotation of said rod;

iii) means for rotating said rod in a first direction to urge relative translation of said linear actuator in a first direction and for rotating said rod in a second direction to urge relative translation of said linear actuator in a second direction;

iv) said linear actuator including means for accommodating continuing rotary movement of said rod in each of the first and second directions in response to said rotating means while said linear actuator remains stationary relative to said rod;

d) a template secured to said base for defining each of the holes to be punched in the beam, said template including means for defining the number and relative position of the holes to be punched in the beam;

e) means extending from said super structure for engaging said defining means of said template in response to translatory movement of said trolley, said engaging means being translated along said template in response to translatory movement of said trolley relative to said base, said engaging means including means for halting translatory movement of said trolley relative to said base and of said linear actuator relative to said rod on engagement of said engaging means with said defining means of said template while rotation of said rod is ongoing in response to continuing actuation of said rotating means; and g) means for actuating the punch and die assembly to punch a hole in the beam upon engagement of said engaging means with said defining means in said template.

3. The apparatus as set forth in claim 2 including means for setting the height of the punch and die assembly relative to said super structure, said setting means comprising guide means interconnecting the punch and die assembly with said super structure for guiding the punch and die assembly during vertical movement of the punch and die assembly and means for raising and lowering the punch and die assembly relative to said super structure.

4. The apparatus as set forth in claim 3 wherein said raising and lowering means includes a jack screw and a motor for actuating said jack screw to raise and lower the punch and die assembly relative to said trolley.

5. The apparatus as set forth in claim 2 wherein the punch and die assembly includes a throat for receiving the beam.

6. The apparatus as set forth in claim 2 wherein the punch and die assembly includes means for supporting the die and a hydraulically operated piston and cylinder unit for actuating the punch; guard means for maintaining the beam adjacent the die during punching of the hole; and means for actuating said piston and cylinder unit to punch a hole in the beam.

7. The apparatus as set forth in claim 2 including a platform extending from said base for supporting said template and means for detachably attaching said template with said platform.

8. The apparatus as set forth in claim 7 wherein said defining means includes holes disposed in said template and said engaging means includes a pin for selectively engaging the holes in said template.

9. The apparatus as set forth in claim 8 wherein said engaging means comprises a manually operated handle and means for pivotally attaching said handle to said super structure for locating said pin relative to said superstructure.

10. The apparatus as set forth in claim 8 wherein each of the holes in said template includes a chamfer for guiding said pin into each of the holes.

11. The apparatus as set forth in claim 2 wherein said base includes at least one track for defining the length and direction of travel of said trolley and wherein said trolley includes at least a wheel depending from said trolley for engaging said track.

12. The apparatus as set forth in claim 11 wherein a pair of wheels for engaging said track.

13. A method for transporting a punch and die assembly with respect to a beam to punch holes in the beam at predetermined locations, said method comprising the steps of:

a) supporting the punch and die assembly from super structure extending from a trolley in operative relationship with the beam;

b) urging transport of the trolley across the base in one of a first direction and a second direction, said step of urging including the steps of:

i) rotating a rod rotatably mounted on one of the base and the trolley in one of a first and second direction;

ii) rectilinearly translating a linear actuator mounted upon the other of the base and the trolley relative to the rod in the one of the first and second directions corresponding with the direction of rotation of the rod in response to exercise of said step of rotating;

iii) translating relative movement between the rod and the linear actuator to corresponding relative movement between the trolley and the base;

c) defining the number and position of the holes to be punched in the beam with a template positionally fixed with respect to the base and having means for defining such number and position of holes;

d) serially engaging the defining means with means extending from the superstructure in response to transport of the trolley across the base to stop transport of the trolley at selected locations corresponding with the holes to be punched by the punch and die assembly while continuing to exercise said step of rotating the rod;

e) continuing to exercise said step of urging during exercise of said step of engaging; and f) actuating the punch and die assembly to punch a hole in the beam upon exercise of said step of engaging.

14. The method as set forth in claim 13 including the step of setting the height of the punch and die assembly relative to the super structure to position the punch and die assembly into operative engagement with the beam and the step of selectively raising and lowering the punch and die assembly with motive means.

15. The method as set forth in claim 13 including the step of replacing the template.

16. The method as set forth in claim 13 wherein the extending means comprises a pivotable handle extending from the super structure which handle includes a pin extending therefrom, wherein the defining means comprises at least one hole in the template wherein the step of serially engaging includes the step of engaging each hole in the template with the pin extending from the handle.

17. The method as set forth in claim 16 including the step of guiding the pin into each hole in the template.

18. The method as set forth in claim 13 including the steps of guiding and limiting the direction and length of translatory movement of the trolley along the base.

* * * * *